United States Patent [19]

Guillot

[11] Patent Number: 4,535,493

[45] Date of Patent: Aug. 20, 1985

[54] CRIB DROP SIDE LATCH

[75] Inventor: Edmond P. Guillot, Putnam, Conn.

[73] Assignee: Gem Industries, Inc., Gardner, Mass.

[21] Appl. No.: 604,731

[22] Filed: Apr. 27, 1984

[51] Int. Cl.[3] ..... A47D 7/02
[52] U.S. Cl. ..... 5/100; 292/305
[58] Field of Search ..... 5/100, 425, 424; 292/305, 67, 63

[56] References Cited

U.S. PATENT DOCUMENTS

| | | | |
|---|---|---|---|
| 3,862,455 | 1/1975 | Turski | 5/100 |
| 3,896,514 | 7/1975 | Fieldstein | 5/100 |
| 3,911,510 | 10/1975 | Bryant | 5/100 |
| 3,919,728 | 4/1975 | Bryant | 5/100 |
| 4,413,365 | 4/1983 | Flye et al. | 5/100 |

*Primary Examiner*—Alexander Grosz
*Attorney, Agent, or Firm*—Charles R. Fay

[57] ABSTRACT

A double action latch for the drop side of a crib, wherein the drop side must be lifted slightly in order for the latch to be free to be actuated.

9 Claims, 5 Drawing Figures

CRIB DROP SIDE LATCH

FIELD OF THE INVENTION

A crib drop side latch requiring two separate actions to unlock it to allow the drop side to drop.

BACKGROUND OF THE INVENTION

Drop side cribs are old and well-known in the art. These drop sides have latches to hold them up. The latches should be impossible or at least extremely difficult for the infant occupant to actuate, for safety reasons, but at the same time, easy to operate by the nurse who should then be free to manually engage the small child. Also, the drop side should be automatically self-locking so that the nurse may set the child down in the crib and raise the drop side and have it automatically lock with no attention.

If the latches require a ten pound pull (or push), they are often unacceptable to the nurse, and often if double acting, they are cumbersome and complicated. The present invention resides in a double action latch practically impossible to actuate by the infant, but quickly and easily actuated by an adult.

SUMMARY OF THE INVENTION

A crib having corner posts, drop rods thereon, and a drop side on the rods, the rods being similarly notched, a latch on the top rail of the drop side at the underside of the top rail and comprising a pair of interpivoted and relatively otherwise movable nesting channels, one channel being a mounting channel fixed to the underside of the top rail of the drop side, and the other channel being reversed relative thereto and having a projection lodgable in a notch to lock the drop side to the rod. The second named channel is manually movable to release the drop side from the drop rod only upon the lifting of the entire drop side slightly from its upper, locked position.

PREFERRED EMBODIMENT OF THE INVENTION

Figure 1:
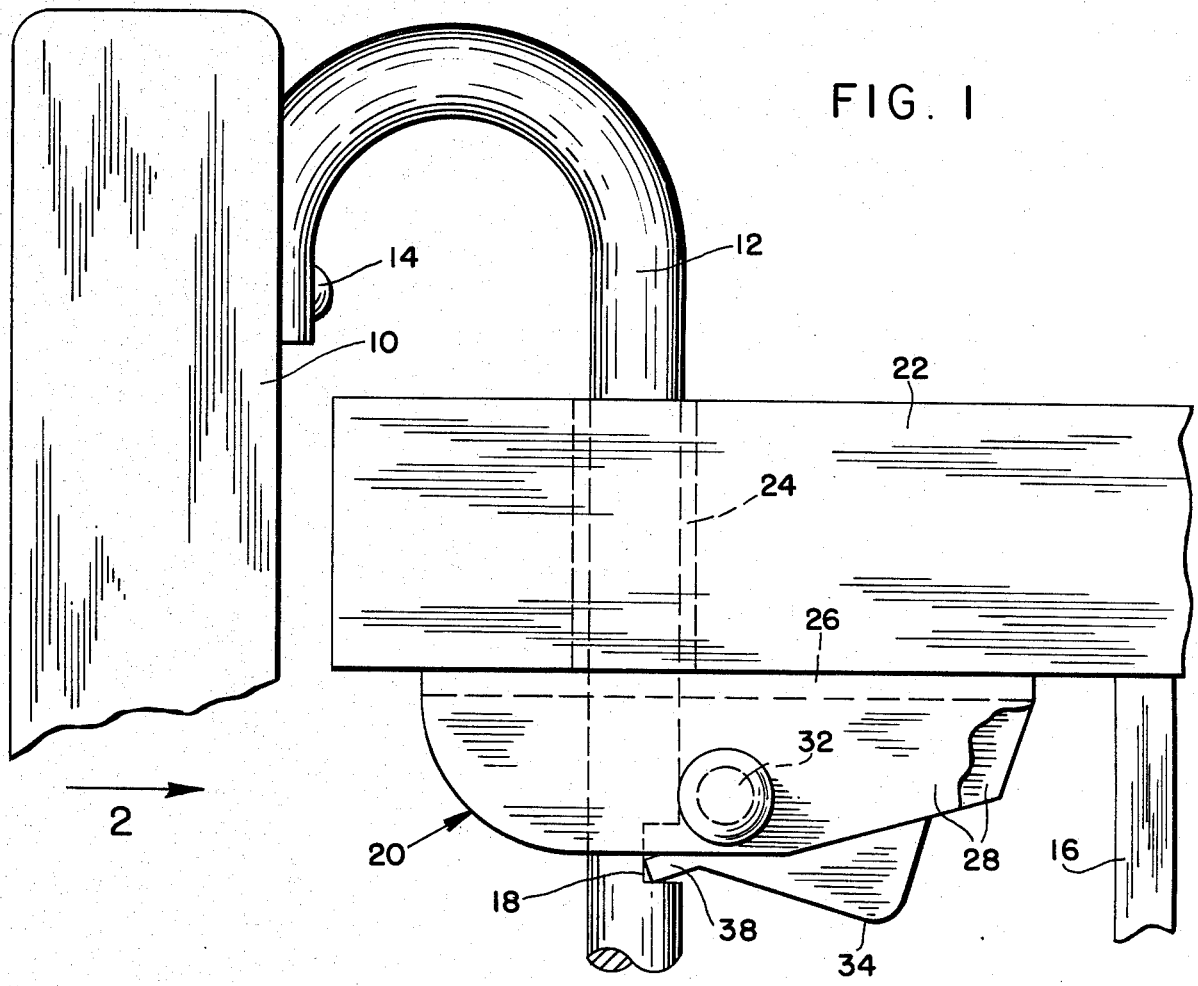
FIG. 1 is a side elevational view of the left hand and of a crib drop side, parts being broken away.
Figure 2:
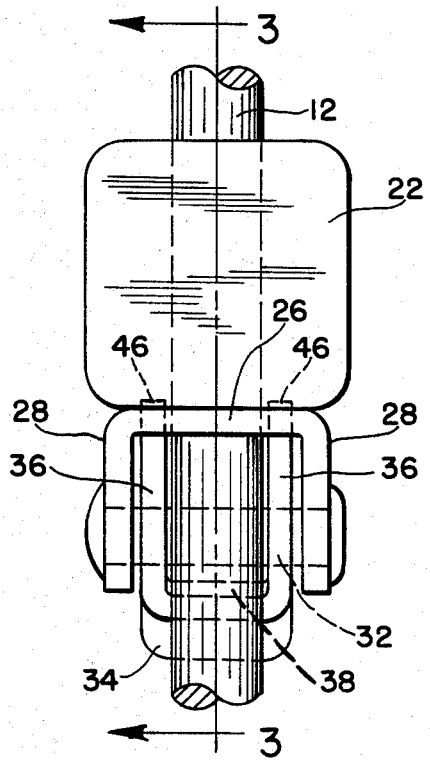
FIG. 2 is an end elevational view of the latch per se looking in the direction of arrow 2 in FIG. 1.

To illustrate the invention, it is shown as applied to the drop side of a crib. Only the left hand latch is illustrated but, as is well known, there is a second-like latch at the right hand end of the drop side. Because both latches in the present case are identical, only one is shown. In the figures, 10 is a corner post of a crib, 12 is a drop rod secured at 14 to the corner post which extends downwards in spaced relation to the corner post and has a stop not shown to hold the drop side 16 in its down position, all as well known in the art. The drop rod has a notch 18 facing right, and the other drop rod not shown has a like notch facing left. The latch is generally indicated at 20 and the right hand latch, not shown but exactly like that at 20, faces the opposite direction to cooperate with its drop rod. The latch is mounted at the underside of the rail 22 of the drop side 16 adjacent to the end thereof, the rail having a vertical aperture 24 slidably receiving the fixed drop rod and the drop side is thus slidable up and down on the drop rods.

The latch includes a mounting channel that has a closed bottom 26 and spaced legs 28, the bottom 26 being apertured to receive a pair of screws or other fastenings 30 securing it in inverted position to the bottom of the rail. A double headed rivet 32 connects legs 28 about midway of the channel ends, this rivet being fixed to and between the legs 28 somewhat closer to the lower edges of the legs than to bottom 26. Mounting channel 26,28, is thus seen to be fixed to the rail 22 with the drop side 12 passing through both rail and mounting channel.

The catch per se is another channel member of very different shape that has a bottom 34, spaced legs 36, and lip 38 projecting from the bottom at one end. The bottom is in the form of an angle, see 40 in FIGS. 3, 4 and 5, and a slot 42 mounts the catch on the rivet 32 for relative motion of the catch relative to the mounting channel. A spring 44 holds the catch down, FIGS. 4 and 5 when free to do so. In the drawings, each leg 36 has a projection of tooth form at 46, these projections pointing upward and acting as catches or sears.

Figure 3:
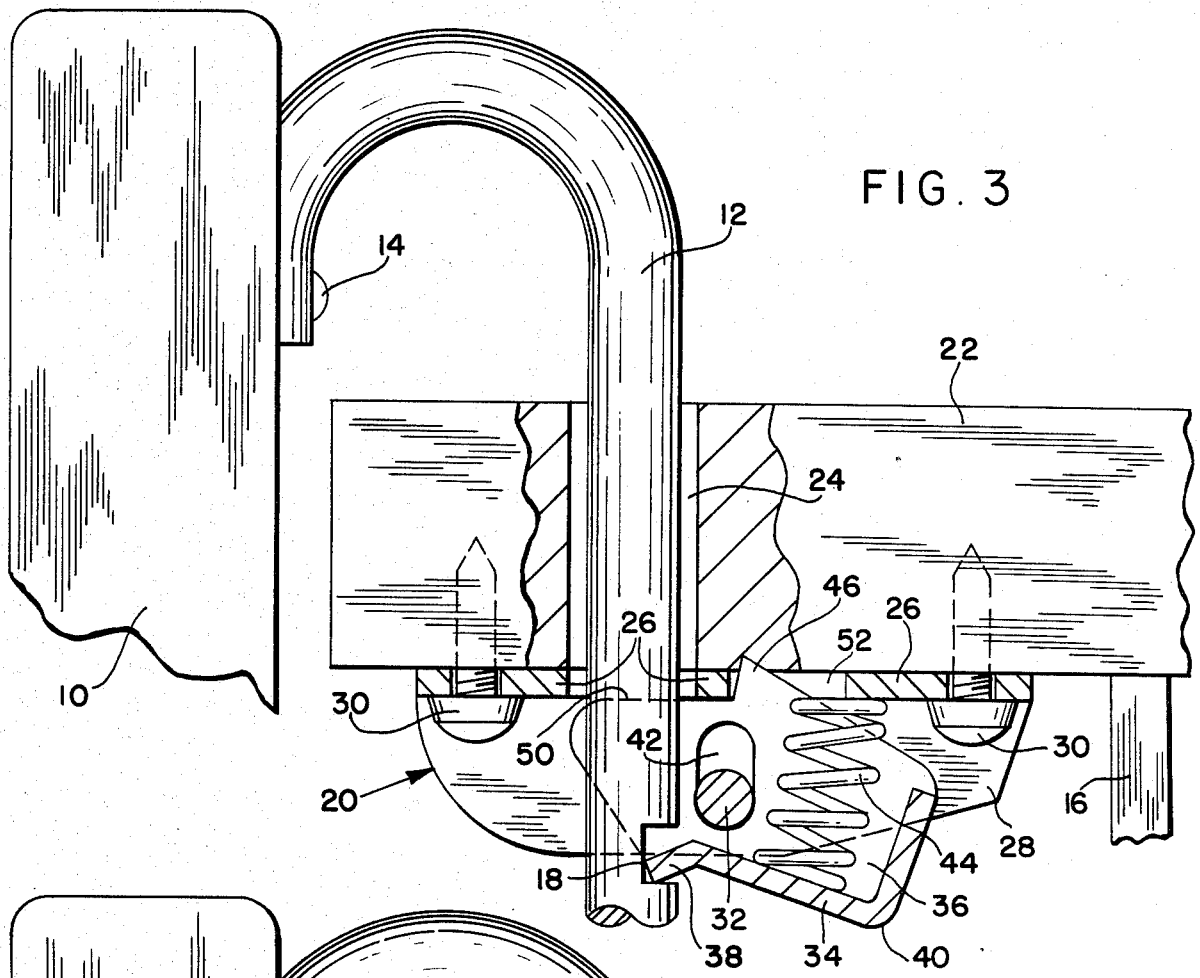
FIG. 3 is a sectional view of the latch et al. looking in the direction of line 3—3 of FIG. 2, showing the parts latched.

Referring to FIG. 3, the drop side is up and latched. To unlatch, the catch 34, 36 must be pressed up, like a trigger, and rotated slightly counter clockwise to release lip 38 from notch 18; otherwise, the latch is fixed and the drop side cannot be dropped. But the projection 46 abuts the underside of rail 22, and this prevents the catch 34,36 from any motion of it counter clockwise while edges 50,50, abutting the underside of the mounting channel bottom 26, prevents rotary motion of catch 34,36, in a clockwise direction. Hence, no matter what forces are applied to the catch 34,36, the drop side cannot be released.

Figure 4:
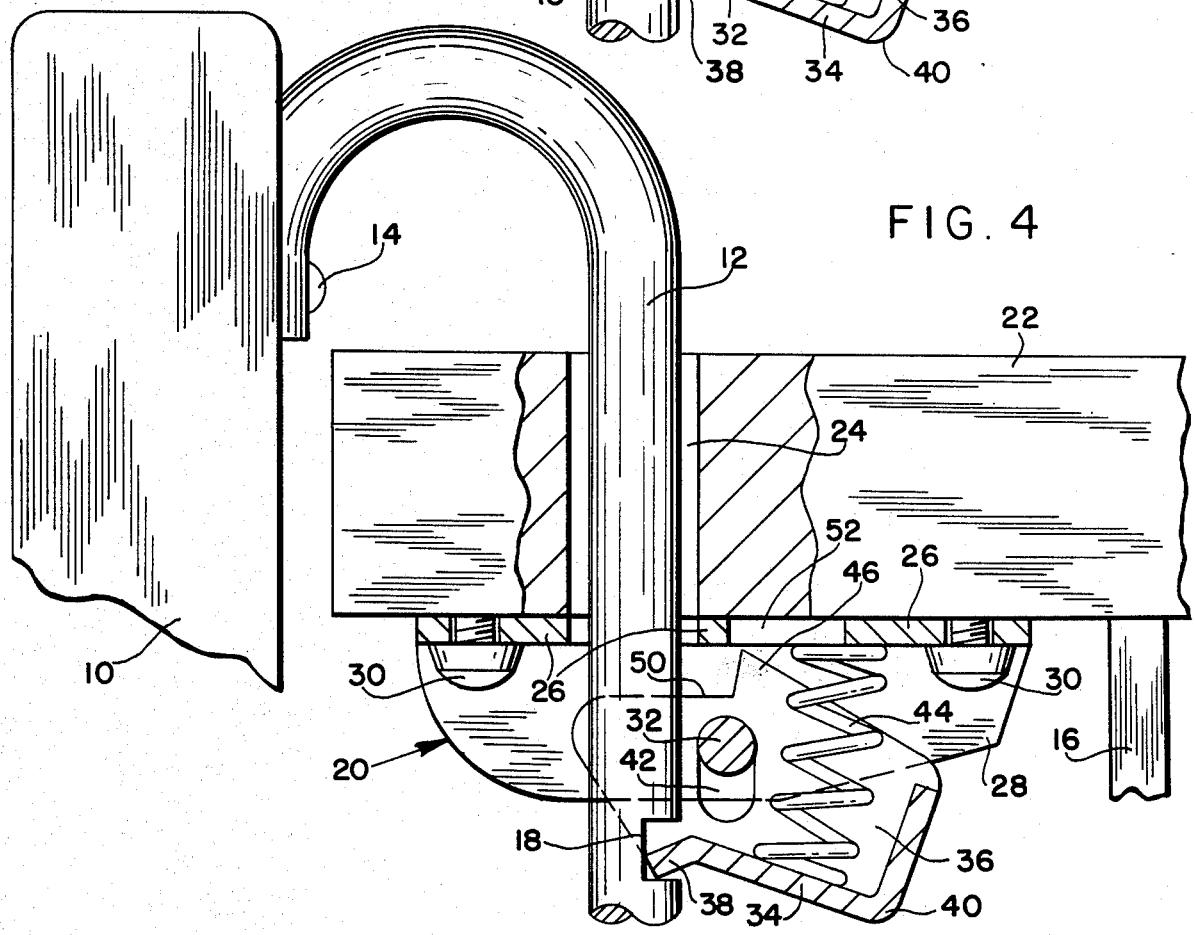
FIG. 4 is a view similar to FIG. 3, showing the first action necessary to release the latch.
Figure 5:
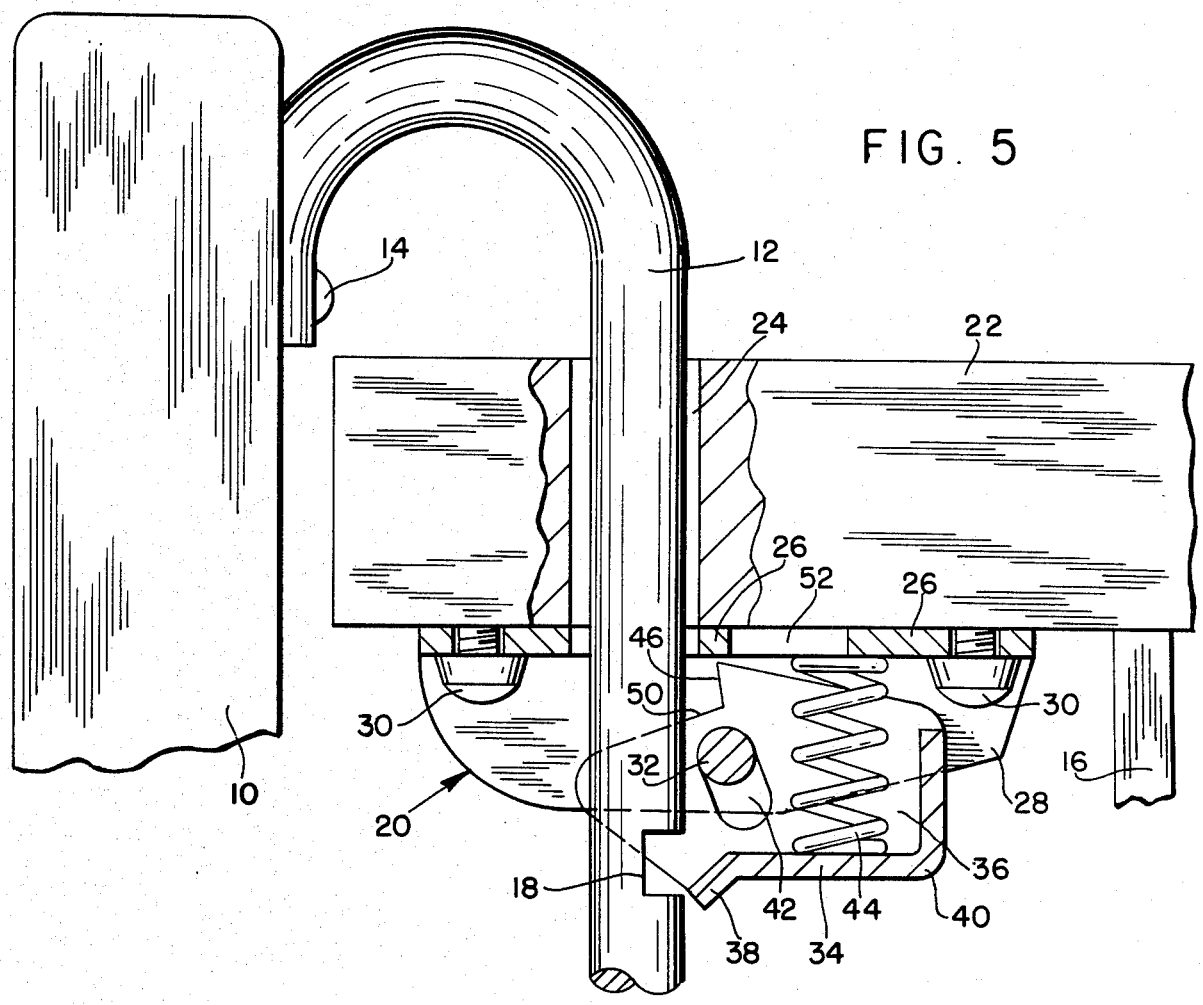
FIG. 5 is a view similar to FIGS. 3 and 4, showing the second action and the latch released and the drop side in condition to fall.

Therefore, it is seen that the drop side, specifically rail 22, must be lifted from the FIG. 3 position to the FIG. 4 position releasing projection 46 from both rail bottom and from the bottom 26 of channel 20. Projection 46, in FIG. 5, projects into a hole 52 in mounting channel bottom 26 and must clear this bottom as in FIG. 4 before upward pressure on catch bottom 34 swings the catch counter clockwise to release lip 38 from notch 18 and allow the drop side to drop. No infant will ever do this, but the adult can do it with one hand by lifting with the fingers, except for the forefinger, and using the forefinger to press on the catch at 34. Note that once the rail 22 is lifted a little, FIG. 4, pressure on the catch at 34 will both rotate it and lift it relative to rivet 32, against the action of spring 44, to bring the catch to the position of FIG. 5, freeing the drop side from the drop rod, and allowing it to drop. When the drop side is pulled back up once more, the lip 38 snaps into the notch 18 and, when the drop side is then manually released, it settles with the rail 22 down on the projection 46 and bottom 26 of mounting channel on edges 50,50 of the latch 34,36.

I claim:

1. A crib having a drop side, a drop rod for the drop side, a notch in the rod, a double acting latch therefor, said latch comprising a first part fixed with relation to the drop side, a second part secured to but movable on the first part, a projection on the second part for selective engagement in the drop rod notch, means holding the second part with the projection in the notch so that the drop side is fixed vertically on the drop rod, said first part being movable upwardly with the drop side releasing said means so that the second part may be moved to release the projection from the notch and the drop side lowered said means including a second projection bearing on a portion of the drop side and held immobile thereby until the drop side is moved upwardly.

2. The crib of claim 1 including a slot on one part and a cross pin in the slot on the other part.

3. The crib of claim 2 including a spring in said means normally holding said parts in a drop side latching relation.

4. The crib of claim 3 wherein the parts are nested U-shaped members each having a bottom and spaced legs.

5. The crib of claim 4 wherein one U-shaped member is a mounting channel with its bottom secured to the drop side and the second part includes the projection as an extending part of the bottom thereof.

6. The crib of claim 5 wherein the cross pin is on the first part secured to and between the legs thereof.

7. The crib of claim 6 wherein the slot is on the second part and said spring is located between the two parts.

8. A fixed support, a member slidable thereon, a rod on the support guiding the member as it slides relative to the support, a notch in the rod, said member including a rail at right angles to the support, the rail having an underside, a latch, said latch comprising an inverted channel having a closed bottom secured to the underside of the rail, a pair of spaced legs extending from the bottom of the channel, a second channel associated with the first named channel, the second channel having a bottom closing the first channel and a pair of spaced legs extending from the bottom of the second channel, said legs nesting with the legs of the first named channel, a rivet passing through the legs of the first channel in fixed relation thereto, aligned slots in the legs of the second channel, said rivet passing through the slots for relative motion of the channels, a spring between the bottom of the channels normally holding the second channel in extended relation to a first channel but secured thereto by the rivet, a pair of spaced projections on the second channel, one projection facing the bottom of the first channel, a hole in the latter, the said one projection normally extending into the hole and engaging the underside of the rail, the other projection engaged in the notch, whereby the member is fixed to the support but is releasable therefrom by raising the member to disengage the one projection from the hole in the bottom of the first channel and thereby allowing manual pressure on the bottom of the second channel to pivot the latter on the rivet disengaging the second projection from the notch and thereby freeing the member from the support.

9. The structure of claim 8 wherein the fixed support is a crib, the slidable member is a crib drop side, and the rod is a crib drop side rod.

* * * * *